United States Patent [19]

Caunt

[11] 4,285,430

[45] Aug. 25, 1981

[54] SKIN PACKAGE

[75] Inventor: Alan Caunt, Leeds, England

[73] Assignee: Baker Perkins Holdings Limited, Peterborough, England

[21] Appl. No.: 98,822

[22] Filed: Nov. 30, 1979

[30] Foreign Application Priority Data

Jan. 26, 1979 [GB] United Kingdom ..... 02891/79

[51] Int. Cl.[3] ..... B65D 73/00

[52] U.S. Cl. ..... 206/471; 206/484; 206/631; 206/632

[58] Field of Search ..... 206/471, 484, 631, 633

[56] References Cited

U.S. PATENT DOCUMENTS

| | | | |
|---|---|---|---|
| Re. 29,705 | 7/1978 | Compere | 206/471 |
| 3,301,392 | 1/1967 | Regan, Jr. | 206/471 |
| 3,305,086 | 2/1967 | Hartman, Jr. | 206/484 |
| 3,326,372 | 6/1967 | Lineman et al. | 206/471 |
| 3,630,346 | 12/1971 | Burnside | 206/484 |
| 3,749,238 | 7/1973 | Taylor | 206/471 |
| 3,881,601 | 5/1975 | Walus et al. | 206/471 |
| 3,891,088 | 6/1975 | Huebner | 206/471 |
| 3,900,105 | 8/1975 | Wolfelsperger | 206/471 |
| 3,924,746 | 12/1975 | Haines | 206/484 |
| 4,174,037 | 11/1979 | Chow | 206/471 |

*Primary Examiner*—Joseph Man-Fu Joseph Moy
*Attorney, Agent, or Firm*—Watson, Cole, Grindle & Watson

[57] ABSTRACT

A skin package wherein an article is enclosed between layers of thermoplastic film joined by heat sealing around the perimeter of the article and including at one side a strip, enclosed between the layers and projecting from them, which is heat sealed to one layer only and is non-adherent or only lightly adherent to the other layer.

3 Claims, 9 Drawing Figures

SKIN PACKAGE

Skin packages are primarily used for packaging articles of irregular shape and such a package, which is generally of rectangular shape, consists of a base layer supporting the article and a top layer of thermoplastic film material, the edge portions of which are sealed to the base layer around the perimeter of the article and the remainder of which makes close contact with the surface of the article.

In one type of skin package the base layer is a card perforated with fine holes and the package is formed by heating the top film and applying suction from below through the holes in the card. Packages of this type are not airtight owing to the holes in the card beneath the enclosed article but they are in common use for the packaging of articles, such as items of ironmongery, which do not required to be packed with complete exclusion of air.

When articles of foodstuff are to be packed an air-free skin package is required and this may be achieved, as described in British Patent Specifications Nos. 1429001 and 1533673, by utilising as the base layer a film of thermoplastic material having a dimpled surface, air being withdrawn from the interior of the package by the suction used in its formation through the air passages available between the dimples.

Skin packages are, however, notoriously difficult to open, particularly when the base layer is of film material, because the top layer closely embraces the article and the two layers are in such close and intimate contact in the areas of the package surrounding the article. The object of this invention is to obviate this disadvantage.

The invention accordingly provides a skin package consisting of an article enclosed between bottom and top layers of thermoplastic material, which are heat sealed together around the perimeter of the article and which make close contact with the surface of the article, the package including, along at least one edge and disposed between said layers, a strip of material which is heat sealed to one only of said layers and extends laterally beyond the other layer so that the package may be opened by separation of the strip from the other layer.

Such a package can readily be opened since the layer at the non-adherent side of the strip can readily be peeled from the strip and then forms a finger grip whereby the sealed areas of the two layers can be pulled apart to expose the article. To facilitate this the edge of the layer at the non-adherent side of the strip preferably terminates short of the outer edge of the strip.

The strip is preferably a header label, which may be printed with information denoting the nature of the packaged article and/or the name of the supplier, and also instructions as to how the package should be opened. The label may be of paper carrying at one side a coating of material ensuring a seal with the layer of the package which contacts that side of the label. Preferably also, to avoid the tendency of paper coated on one side only to curl, the label carries at the other side a coating of material which will not form a seal with the contacting layer of the package.

The invention will now be described in more detail, by way of example, with reference to the accompanying drawings, in which.

Figure 1:
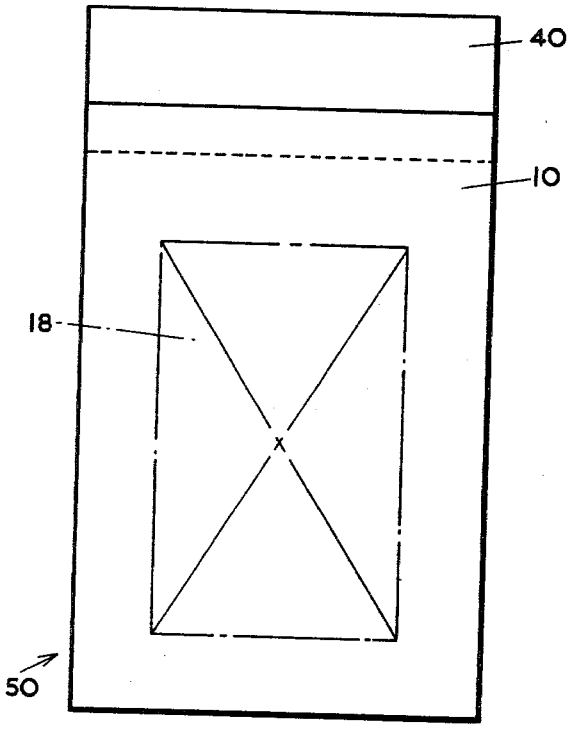
FIG. 1 is a plan view of a skin package according to the invention.
Figure 3:
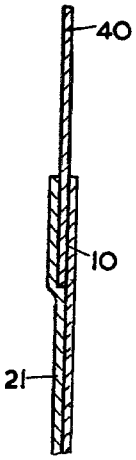
Figure 4:
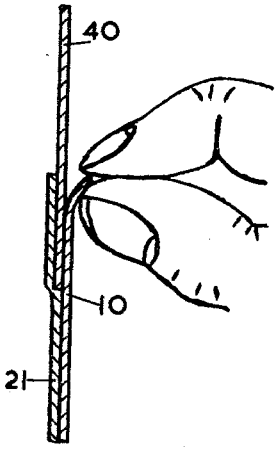
Figure 5:
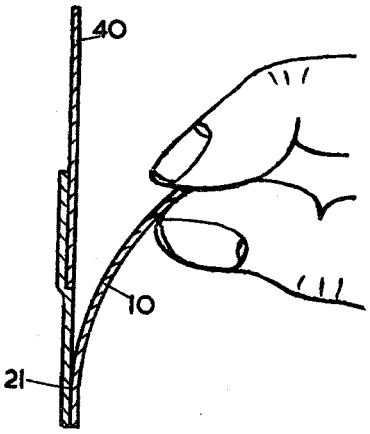
Figure 6:
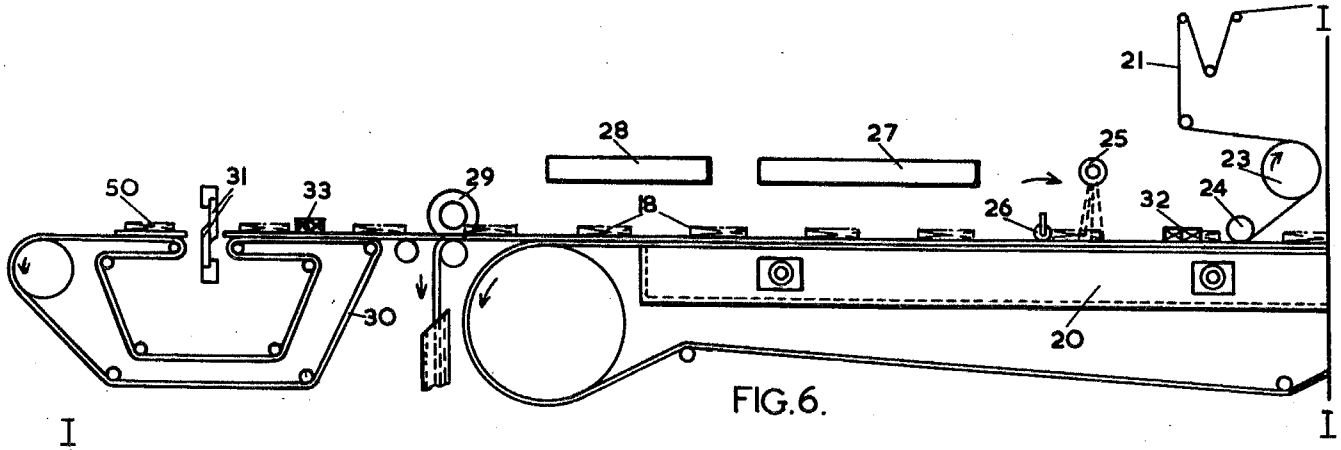
Figure 7:
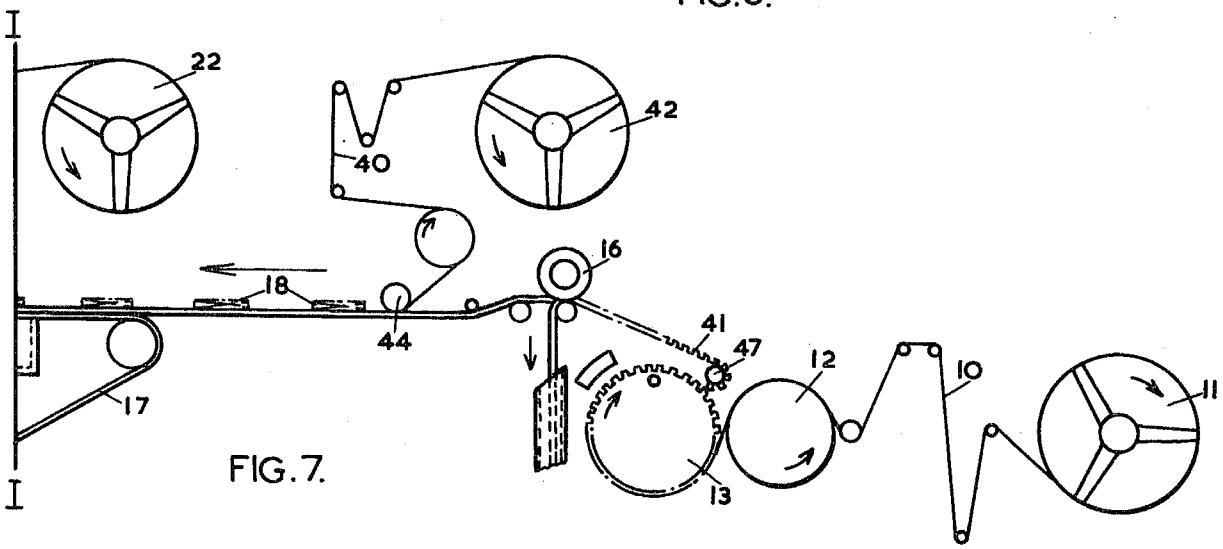
Figure 8:
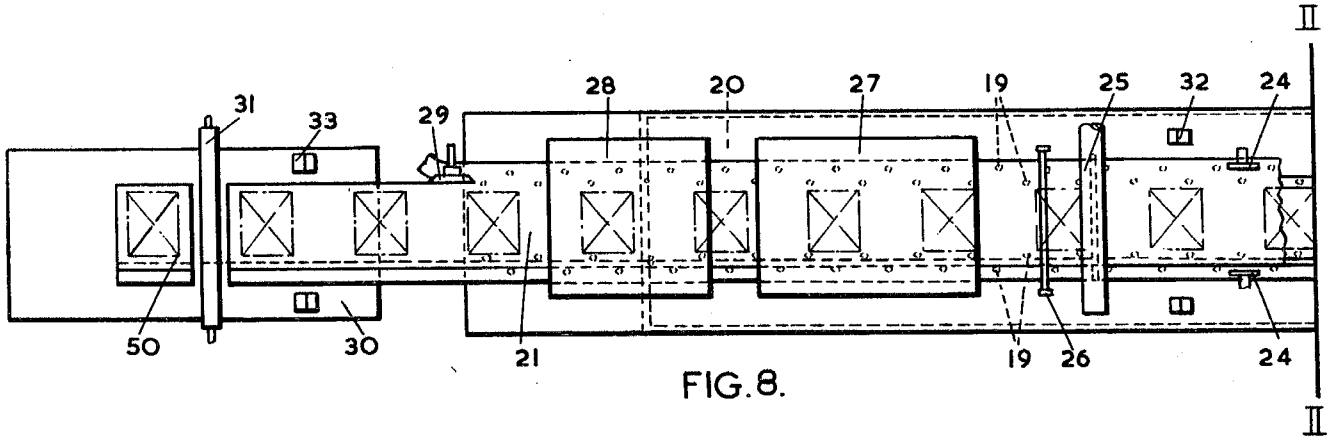
Figure 9:
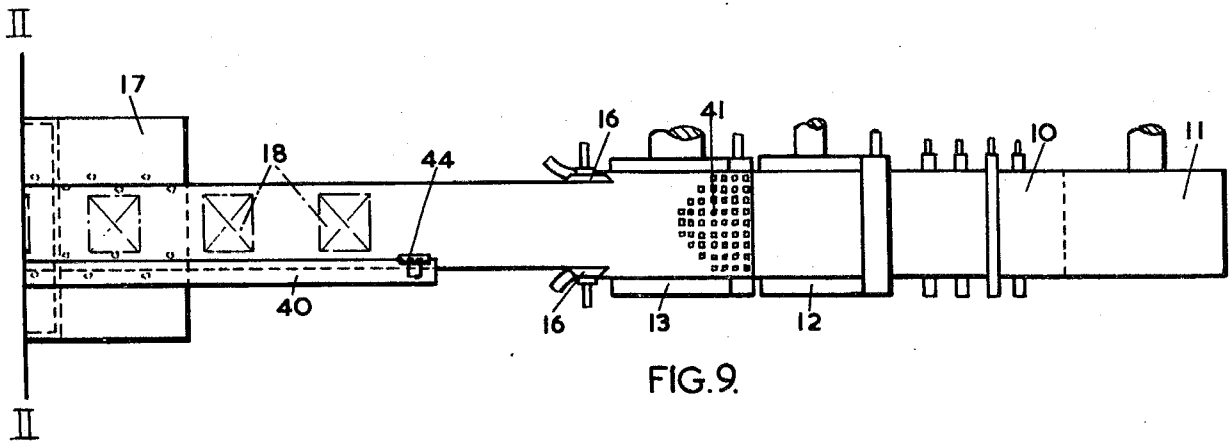

FIGS. 3, 4 and 5 are sectional views on a larger scale illustrating successive stages in opening of the package, FIGS. 6 and 7, which adjoin at the line I—I, constitute a side elevation of a machine for manufacturing skin packages as shown in FIG. 1, and FIGS. 8 and 9, which adjoin at the line II—II, constitute a corresponding plan view, with certain parts omitted.

Figure 2:
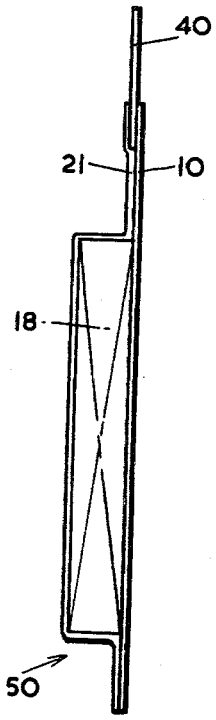
FIG. 2 is a corresponding side view.

The package 50 shown in FIGS. 1 and 2 consists of an article 18, enclosed between a dimpled lower web 10 of thermoplastic material and an undimpled upper web 21 also of thermoplastic material, and a header label 40, having an inner portion disposed between the edges of the webs 10, 21 at one side of the package and an outer portion which projects beyond said edges. The webs 10, 21 are sealed together in a zone surrounding the article 18 and disposed between the label 40 and the article.

In a preferred embodiment the dimpled lower web 10 and the upper web 21 are both made of a film supplied by E. I. DuPont de Nemours & Co. (Inc.) under the Registered Trade Mark "SURLYN", and consisting of an ionomer resin derived from a carboxylic-acid-containing monomer copolymerized with ethylene and the label 40 is made of bleached kraft paper, coated on its upper surface with SURLYN which forms a strong bond with the upper web 21 and on its lower surface with low density polyethylene which forms a weak bond only with the dimpled lower web 10.

The package can be easily opened because the person concerned can, as shown in FIG. 4, easily grip with his fingers the lightly adherent edge of the dimpled lower web 10 adjoining the label 40. Thereafter, as shown in FIG. 5, owing to the firm bond between the label 40 and the upper web 21, the webs 10 and 21 can be easily peeled apart by holding the lower web in one hand and the upper web in the other hand (not shown).

Skin packages as shown in FIG. 1 may be made by a modification of the machine described in British Patent Specification No. 1533673 shown in FIGS. 6 and 7.

As there shown, the lower web 10 in undimpled form is fed from a reel 11 around a drum 12, containing an internal heater, and then around an adjacent thermoforming drum 13 which provides the web 10 with a dimpled surface as fully explained in British Patent Specification No. 1533673, the dimpling of the web being indicated at 41. The web 10 passes from the drum 13 over a roller 47 to a pair of edge trimming knives 16 and thence, over a stationary table (not shown) to a conveyor belt 17, articles 18 to be packaged being placed on the web 10 at regular intervals as it travels towards the belt 17.

A strip 40 of header label material, fed from a reel 42, is guided by a roller 44 into contact with one side of the web 10 of material at a point in advance of that at which the articles 18 are placed on the web 10, the outer edge of the strip being so positioned, as shown in FIGS. 8 and 9, as to project beyond the underlying edge of the web 10.

The web 10, the articles 18 carried thereby, and the strip 40 are carried by the belt 17 over a suction box 20. The suction box applies suction through perforations 19 (FIG. 8) near the edges of the belt 17 to hold the web 10 to the belt 17.

The upper web 21 is fed from a reel 22 over a heated drum 23 to rollers 24 which press its edges against the belt 17, the web 21 thereafter being held down by the suction applied through the perforations 19 in the belt. Beyond the rollers 24 further heat is applied to the upper web by a hot air blower 25. The width and feed of the upper web 21 are such that the edges of the webs 10 and 21 are in register at the side at which the strip 40 is applied and the upper web 21 overlaps the lower web 10 at the other side only. As described above, the strip 40 carries on its upper surface a coating which will form a seal with the upper web 21 and on its lower surface a coating which does not adhere significantly to the narrower lower web 10. The strip 40 is thus inserted between the webs 10, 21 so that its outer edge projects beyond the edge of both webs.

A rotary clamp 26 operates to press the upper web 21 against the lower web 10 after each article 18 has passed the clamp. As more fully described in British Patent Specification No. 1429001 the suction box 20 is effective to draw air from the enclosure formed by the webs 10, 21 owing to the dimpled formation of the lower web 10.

Beyond the clamp 26 is a radiant heater 27, which provides heat to seal the webs 21, 10 together around each article 18 and also to seal the strip 40 to the upper web 21. The packages then pass beneath a cooler 28 and the edge of the upper web 21 remote from the strip 40 is trimmed by a knife 29. The superposed webs 21, 10 then pass to a further conveyor 30 and are severed between the articles 18 by knives 31 to produce individual packages.

A photocell 32 senses the approach of successive articles and operates to trigger the rotary clamp 26 and a similar photocell 33 (FIG. 8) triggers the knives 31.

The strip 40 may carry markings indicative of the lengths into which it is severed by the knives 31. These markings serve to assist an operator in correctly placing the articles 18 on the lower web 10 in the case of manual feed of the articles. In the case of automatic article feed they can be used to activate a photoelectric cell which controls the article feeding mechanism.

If desired strips 40 of header label material can be supplied to both sides of the machine, in which case the edge trimming knife 29 would be omitted. As a further alternative the strip 40 can be wider than the upper web and formed with spaced apertures through which the articles 18 are placed on the lower web 10.

The strength of the bond between the two webs 10, 21 can be controlled by regulation of the amount of heat applied in the machine to their contacting surfaces. Excessive heating of the webs should be avoided to ensure that they will not fuse together and so prevent easy opening of the package.

What I claim as my invention and desire to secure by Letters Patent is:

1. An air-free skin package consisting of an article enclosed between a generally flat bottom layer of thermoplastic film having a dimpled surface contacting said article and a top layer of thermoplastic film having a domed portion accommodating said article, said layers being heat sealed together in a zone immediately surrounding the entire perimeter of the article and being in close and intimate contact with the entire surface of said article, said package being devoid of any weakened severance line and including, along at least one edge and disposed between said layers, a strip of material which is heat sealed to one only of said layers and extends laterally beyond the other layer so that the package may be opened by separation of the strip from the other layer.

2. A skin package according to claim 1, wherein the strip is of paper carrying at one side only a coating which is capable of forming a heat seal with the contacting layer of the package.

3. A skin package according to claim 2, wherein the strip carries on the other side a coating incapable of forming a heat seal with the contacting layer of the package.

* * * * *